United States Patent [19]

DeSantis

[11] 4,153,399

[45] May 8, 1979

[54] MULTIPLE PUNCH TOOL SET FOR POWDER COMPACTING PRESS

[75] Inventor: Raymond P. DeSantis, Royal Oak, Mich.

[73] Assignee: PTX-Pentronix, Inc., Lincoln Park, Mich.

[21] Appl. No.: 831,372

[22] Filed: Sep. 8, 1977

[51] Int. Cl.[2] ..... B30B 11/02

[52] U.S. Cl. ..... 425/78; 425/414; 425/416; 425/344

[58] Field of Search ..... 425/78

[56] References Cited

U.S. PATENT DOCUMENTS

| | | | |
|---|---|---|---|
| 2,509,783 | 5/1950 | Richardson | 425/78 |
| 2,762,078 | 9/1956 | Haller | 425/78 |
| 3,172,156 | 3/1965 | Belden | 425/78 |
| 3,337,916 | 8/1967 | Smith | 425/78 |
| 3,353,215 | 11/1967 | Haller | 425/78 |
| 3,524,220 | 8/1970 | Davison | 425/78 |
| 3,647,332 | 3/1972 | Schmaus | 425/78 |
| 3,664,784 | 5/1972 | Sibley | 425/78 |
| 3,671,157 | 6/1972 | Smith | 425/78 |

*Primary Examiner*—J. Howard Flint, Jr.

*Attorney, Agent, or Firm*—Hauke and Patalidis

[57] ABSTRACT

A punch and die set for operation by the ram of a powder compacting press, comprising at least three concentrically disposed telescopic punches independently reciprocable within a single die cavity. Each punch is separately supported by a punch holder plate, one of which is directly reciprocable from the press ram, another of which is reciprocable by way of appropriate abutments dependent from the first punch holder and the third of which is independently reciprocable relative to the first one by way of fluid pressure.

16 Claims, 13 Drawing Figures

10
13
12

90
86
94
222
96
100
224
110
114
106
116
218
14
216
220
174
172

20
56
50
36
42
34
40
38
52
18
16
24
28
62
54
58
60
66
22
64
89
68
70
9
92
90
88
86
94
214
26
32
148
96
100
98
10
211
104
102
110
142
146
152
114
112
150
11
106
115
116
136
108
76
30
149
162
164
132
160
156
158
159
154
14
72
166
134
74
210
78
80
84
82
140
138
126
128
131
130
174
212
188
186
178
176
182
209
208
180
170
192
184
198
200
172
194
202
204
196
206
190
120
124
122

13
11
12

MULTIPLE PUNCH TOOL SET FOR POWDER COMPACTING PRESS

CROSS-REFERENCE TO RELATED PATENTS

The present invention relates to a punch and die unitary tool set for operation by a powder compacting press as disclosed in U.S. Pat. Nos. 3,328,840, 3,561,054, 3,561,056, 3,574,892, 3,645,658, 3,715,796, 3,730,659, 3,741,697 and 3,826,599, all assigned to the same assignee as the present application. The present application is an improvement of the telescopic punch assembly or tool set disclosed in U.S. Pat. Nos. 3,593,366 and 3,671,157, also assigned to the same assignee as the present application.

BACKGROUND OF THE INVENTION

The present invention relates to an improved unitary tool capsule or tool and die assembly for powder compacting presses. More particularly, the present invention relates to a tool and die set provided with a plurality of telescopic concentric punches for a single die cavity which are actuatable by a single-action powder compacting mechanical press having a cam-actuated ram.

In U.S. Pat. Nos. 3,593,366 and 3,671,157, there are disclosed powder compacting tool sets comprising dual, telescopic punches axially movable relative to and independently of each other in a precisely adjusted relationship, for forming against the surface of an anvil overlapping the opening of the die cavity, complex shaped articles such as cups, flanged buttons and the like.

The present invention represents a further advance in the technology of compacting relatively complex articles by means of at least three telescopic coaxial punches independently reciprocable by means of a single cam-actuated ram and by means of fluid pressure such as hydraulic or pneumatic fluid pressure, combined with means for the independent adjustment of each punch member such as to establish the desired characteristics for density, thickness and acurate dimensional consistency of the finished articles.

SUMMARY OF THE INVENTION

The principal object of the present invention therefore is to provide a novel unitary punch and die set for a powder compacting press adapted to compact, from powder material, an article of complex shape, through a single stroke of the ram of a press, by means of a multi-punch assembly, each of the several punches, which are disposed concentric to each other, being independently actuated and adjusted relative to the others. For forming articles provided with an aperture, a stationary adjustable core rod is also provided.

The many objects and advantages of the present invention will be apparent to those skilled in the art when the following detailed description of the best mode contemplated for practicing the invention is read in conjunction with the accompanying drawing wherein like reference numerals refer to like parts and in which:

DETAILED DESCRIPTION OF THE PREFERRED EMBODIMENTS

Figure 1:
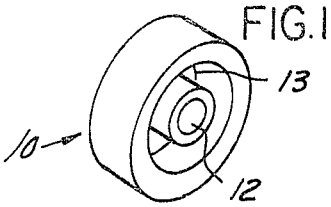
FIG. 1 is a perspective view of an example of article made of compacted powder material by means of the punch and die assembly of the present invention.
Figure 2:
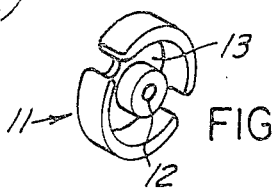
FIG. 2 is a perspective view of another example of part.
Figure 11:
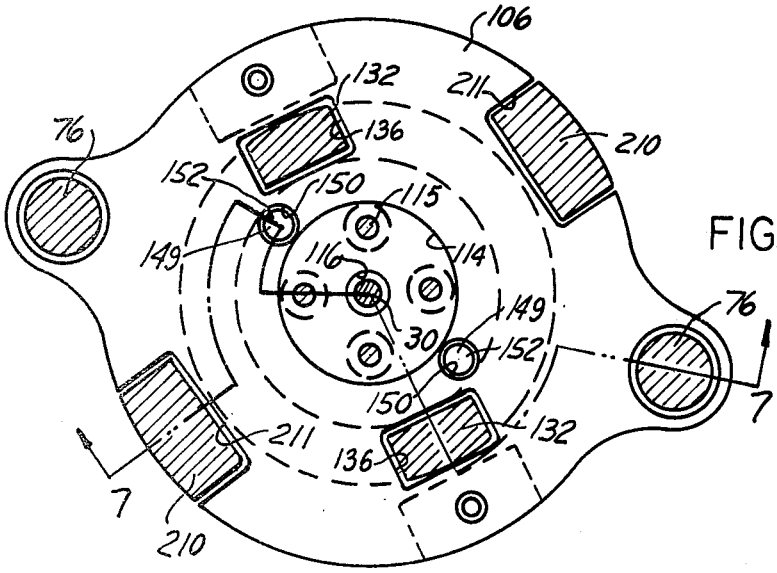
FIG. 11 is a view from line 11—11 of FIG. 7.

Referring now to the drawing and more particularly to FIGS. 1 and 2, the invention is particularly well adapted for compacting from powder material articles such as the cup-shaped article 10 of FIG. 1 or 11 of FIG. 2, each provided with, for example, a centrally disposed aperture 12 and an annular recess 13. Such articles, compacted from powder metal, ceramic, glass or the like, are obtained by means of a triple-punch tool set 14, schematically illustrated through consecutive steps of operation at FIGS. 3–6.

As schematically illustrated at FIGS. 3–6, a punch and die set 14 according to the present invention comprises an outer punch 16 reciprocable in a bore 18 formed in a die plate 20. The outer punch 16 has a longitudinal bore 22 in which is reciprocably disposed an intermediary punch 24. The intermediary punch 24 is in turn provided with a longitudinal bore 26 in which is reciprocably disposed an inner punch 28. The tool set 14 further comprises a core rod 30 disposed in a longitudinal bore 32 formed in the inner punch 28. As will be explained hereinafter in further detail, the outer punch 16, the intermediary punch 24 and the inner punch 28, which are disposed telescopically and concentric to each other in the example illustrated, are reciprocable independently of each other by the press mechanism, not shown, while the core rod 30 is generally held in a fixed position with its end face 34 flush with the upper surface 36 of the die plate 20.

The outer punch 16 has an annular end face 38 which is concentric to the annular end face 40 of the intermediary punch and also concentric to the annular end face 42 of the inner punch 28. In the position illustrated at FIG. 3, the annular end face 40 of the intermediary punch 24 is disposed at a level which is at a predetermined distance below the upper surface 36 of the die plate 20, and the annular end faces 42 and 38 of the inner punch 28 and outer punch 16, respectively, are disposed coplanar and a predetermined distance below the surface of the end face 40 of the intermediary punch 24. The space above the end faces of the three punches is filled with powder material 41, by way of a powder dispenser, not shown, which forms part of the work station positioner of the press, in the same manner as explained in the aforesaid U.S. patents. The space above the punch end faces, which defines a die cavity 44, is filled with powder material 41 to a level even with the upper surface 36 of the die plate 20 as a result of the wiping action of the edge of the powder dispenser.

Figure 4:
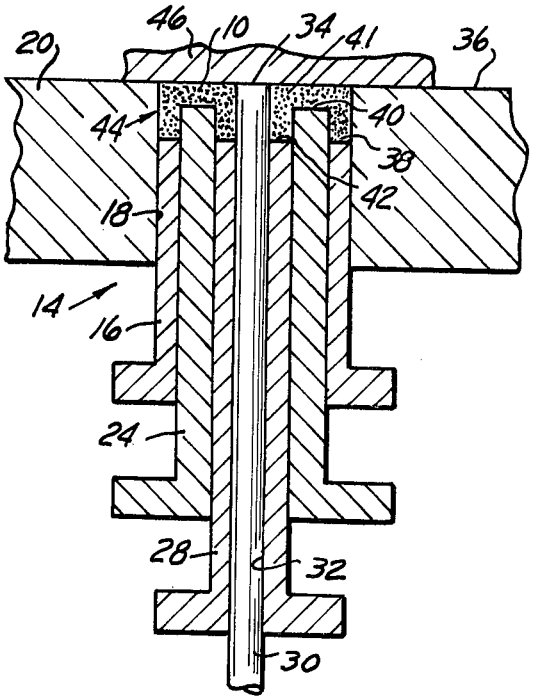
FIG. 4 is a view similar to FIG. 3 but showing the respective positions of the punches in the press position.

After filling of the die cavity 44 with powder material 41, the anvil 46, FIG. 4, which also forms part of the work station positioner, is placed overlapping the die cavity 44 and clamped in position, the overlapping portion of the anvil 46 being firmly engaged with the upper surface 36 of the die plate 20. The intermediary punch 24 is advanced a predetermined distance while the outer punch 16 and the inner punch 28 are advanced a greater distance, such as to compact the powder material 41 in the die cavity 44 against the face of the anvil 46 to an appropriate shape and to appropriate dimensions. The outer punch 16 and the inner punch 28 are advanced simultaneously and in unison the same relative distance toward the face of the anvil 46 such as to remain constantly coplanar.

Figure 5:
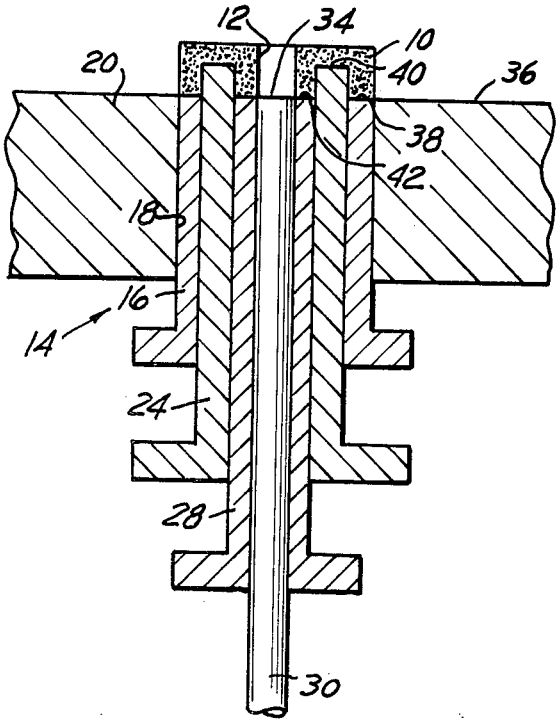
FIG. 5 is a view similar to FIG. 4, but showing the respective positions of the punches during ejection of the part from the die cavity.

At FIG. 5, the three punches 16, 24 and 28 have been moved in unison, after removal of the anvil 46 from above the die cavity, to a position whereby the annular end face 38 of the outer punch 16 and the annular end face 42 of the inner punch 28 are flush with the upper surface 36 of the die plate 20, the annular end face 40 of the intermediate punch 24 remaining relative to the annular end faces 28 and 42 of the other punches in the position which it occupied during pressing (FIG. 4). The compacted article 10 is therefore ejected and projects above the die plate 20, and the end face 34 of the core rod 30 is about flush with the end of the aperture 12 in the part 10.

Figure 6:
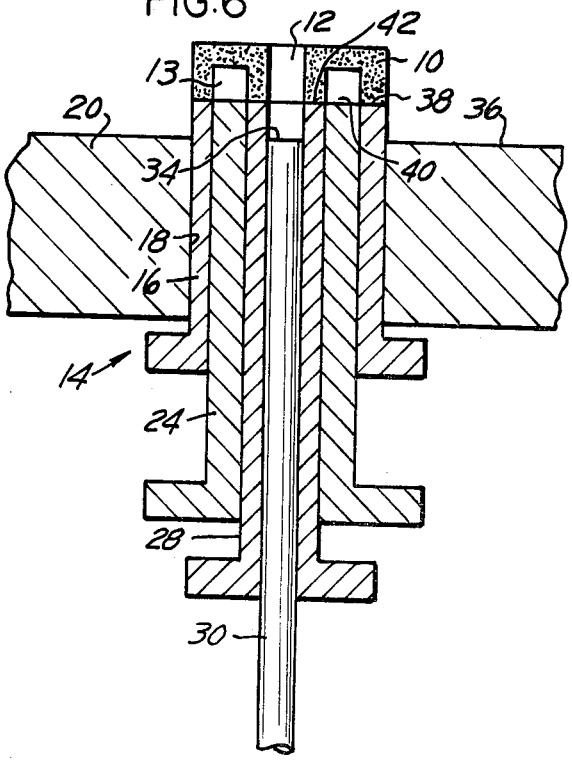
FIG. 6 is a view similar to FIG. 5, and showing the end of the part ejection step.

The next step, which is illustrated at FIG. 6, consists in maintaining the intermediary punch 24 stationary, while the outer punch 16 and the inner punch 28 are further advanced in unison, so as to disengage completely from the annular groove 13 of the part 10. The part 10 is therefore completely ejected and freed from the punches and can be picked up and carried away by any appropriate means such as mechanical means or vacuum suction means. It will be readily apparent that alternatively, in order to free the part 10, the inner and outer punches 28 and 16, respectively, may be maintained in the position that they occupied at FIG. 5, while the intermediate punch 24 is retracted to a position whereby its annular end face 40 is flush with the annular end faces 28 and 42 of the outer punch 16 and the inner punch 28, respectively.

The punches 16, 24 and 28 are subsequently differentially retracted within the die bore 18 to the position illustrated at FIG. 3, at which time the die cavity 44 is again filled with powder material 41, and the diverse steps of pressing and ejecting the part 10 are repeated.

Referring now to FIGS. 7–11, there is illustrated in detail a punch and die assembly 14 according to the present invention which comprises an outer punch 16 made preferably of an ultra-hard material, such as tungsten carbide and the like, which is slidably disposed in the bore 18 of a die bushing 50, also made of ultra-hard material such as tungsten carbide or the like. The die bushing 50 is press-fitted, cemented, or otherwise fastened in the shouldered bore 52 of a die button 54 removably fitted in a bore 56 formed in the die plate 20. The die plate 20 is in turn mounted on the top of a spacer plate 58 by any appropriate means such as screws, bolts or the like, not shown. The bore 56 in the die plate 20 has an annular shoulder 60 engaging an annular shoulder 62 in the periphery of the die button 54, and the die button 54 and, consequently, the die bushing 50 are held removably in position by means of an annular retainer 64 having a peripheral thread engaging an internally threaded bore 66 formed in the spacer plate 58, substantially according to the arrangement disclosed and claimed in co-pending application Ser. No. 734,970, filed Oct. 22, 1976, issued Oct. 11, 1977 as U.S. Pat. No. 4,053,267 and assigned to the assignee of the present application.

The punch and die assembly 14 is mounted in an appropriate aperture 68 formed in the table 70 of a press, not shown, by any appropriate means such as bolts or clamps.

Figure 7:
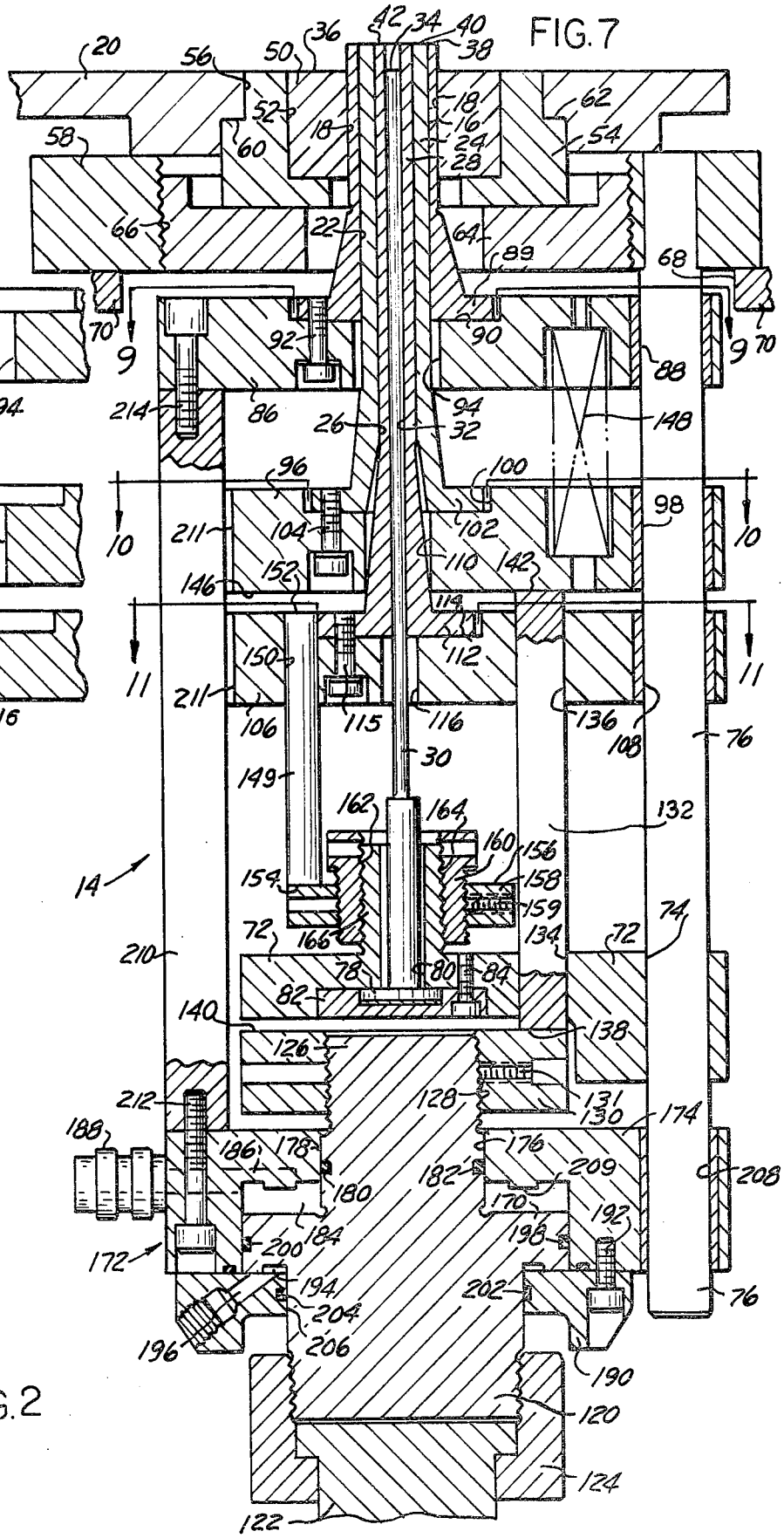
FIG. 7 is a sectional view of a multi-punch and die assembly according to the present invention, taken substantially along lines 7—7 of FIGS. 9–11.

The outer punch 16 has a longitudinal bore 22 through which is slidably disposed the intermediary punch 24, having in turn a longitudinal bore 26 through which is slidably disposed the inner punch 28. The inner punch 28 is also tubular and has a longitudinal bore 32 accepting therethrough the core rod 30. The three concentric punches and the core rod 30 are shown at FIG. 7 in the position corresponding to the full ejection of the compacted article, not shown, as illustrated at FIG. 6, the annular face 38 of the outer punch 16 being coplanar with the annular face 40 of the intermediary punch 24 and the annular face 42 of the inner punch 28. The end face 34 of the core rod 30 is maintained fixedly flush with the surface 36 of the die plate 20 and the die bushing 50.

Figure 9:
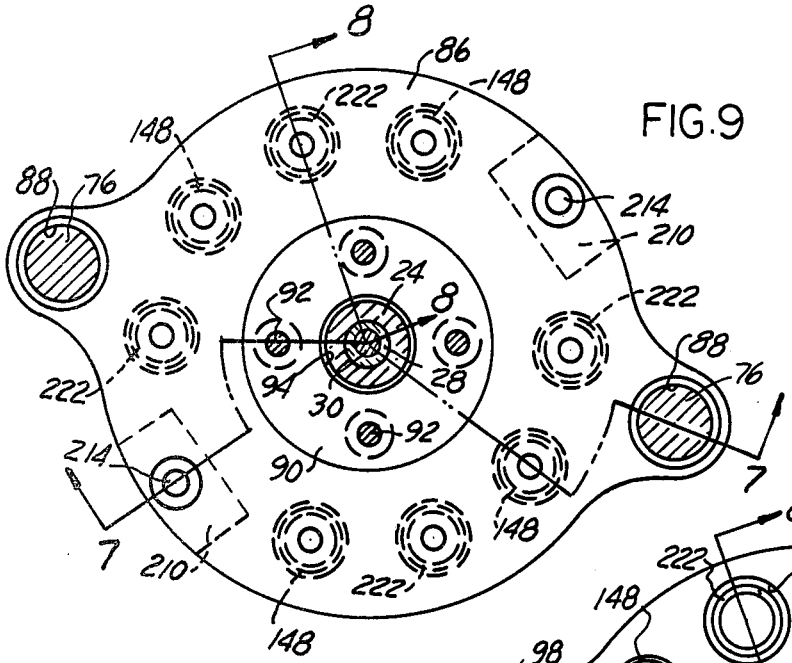
FIG. 9 is a view from line 9—9 of FIG. 7.

The core rod 30 is supported by a core rod holder 72 which is in the form of a plate having a pair of bores 74 through each of which is passed a column 76, see also FIGS. 9–11, which projects below the die spacer plate 58. The core rod holder 72 is affixed to the columns 76 by convenient means such as set screws, not shown, such that the end face 34 of the core rod 30 may be adjusted to any appropriate longitudinal position. If so desired, the core rod holder 72 may be made reciprocable relative to the support columns 76 and reciprocated in unison with one of the punches, or independently, by means alike those described hereinafter for reciprocating the punches.

The core rod 30 is held in its holder 72 by being provided with an enlarged disk-like foot portion 78 formed integral at the end of the core rod 30, the body of the core rod 30 passing through a longitudinal bore 80 formed in the holder 72. The core rod foot portion 78 is held in position in the holder 72 by a retainer plate 82 fastened to the bottom of the holder 72 by means such as screws 84.

The outer punch 16 is held by a punch holder in the form of a plate 86 which is provided with a pair of bushed bores 88 slidably accepting the support columns 76 therethrough. The outer punch 16 is provided with an enlarged foot portion 89 inserted in a recess 90 formed on the top of the plate 86 and is held in position by means of fasteners such as screws 92. The plate 86 is provided with a substantially centrally disposed bore 94 allowing the periphery of the intermediary punch 24 to project therethrough.

Figure 10:
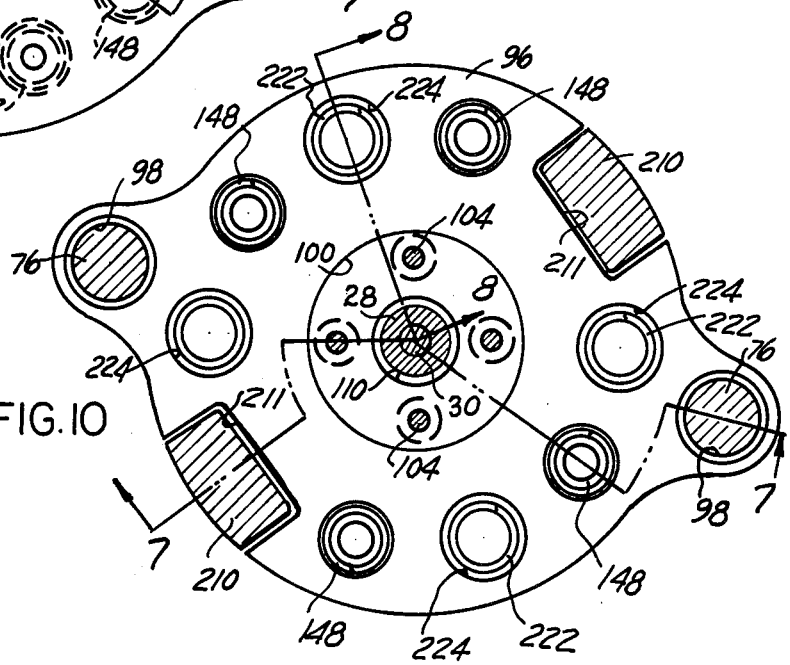
FIG. 10 is a view from line 10—10 of FIG. 7.

The intermediary punch 24 is supported by a punch holder plate 96 also reciprocably supported by the columns 76 passing through a pair of bearing-provided bores 98, FIGS. 7 and 10. The plate 96 has a circular recess 100 at the center of its upper surface which accepts the enlarged foot portion 102 of the intermediate punch 24, appropriate bolts or screws 104 holding the punch securely in position on the holder plate 96.

The inner punch 28 is similarly held by a punch holder plate 106 slidably supported by the support columns 76, each passed through one of a pair of bearing-provided bores 108. The bottom of the inner punch 28, which freely passes through a central bore 110 in the intermediary punch support plate 96, is provided with an enlarged foot portion 112 disposed in a recess 114 formed in the upper surface of its support plate 106, and is fastened therein by means of fasteners such as bolts 115. The inner punch holder plate 106 has a central aperture 116 affording passage to the core rod 30.

A punch actuating member 120 is coupled to the ram 122 of the press by means of a threaded collar coupling 124. The actuating member 120 has a reduced diameter upper end 126 provided with a peripheral thread 128 accepting an internally threaded adjusting ring 130 affixed in an appropriate position by way of radial set screws 131. A pair of actuating bars 132 passed through appropriate aligned apertures 134 and 136 respectively in the core rod support plate 72 and in the inner punch support plate 106 have each a lower end face 138 abutting the upper surface 140 of the adjusting ring 130 and an upper end face 142 capable of abutting against the lower surface 146 of the intermediary punch holder plate 96. Therefore, upward motion of the actuating member 120 results in upward motion of the intermediary punch holder plate 96 and consequently of the intermediary punch 24, through the connection provided by the actuating bars 132. The adjustment of the ring 130 along the threaded end portion 128 of the actuating member 120 determines the maximum advance of the annular end face 40 of the intermediary punch 24. A plurality of compressed coil springs 148, disposed between the top of the intermediary punch holder plate 96 and the bottom of the outer punch holder 86, constantly urge the two punch holder plates away from each other.

The amount of reciprocation of the intermediary punch holder plate 96 towards the stationary core rod holder plate 72 is adjustably determined by means of a pair of adjustment rods 149 passed through apertures 150 in the inner punch holder plate 106 and having an upper end 152 engageable with the lower surface 146 of the intermediary punch holder plate 96. The lower end 154 of each rod 148 abuts against the upper face 156 of an internally threaded adjusting ring 158 threading around the threaded periphery of an adjusting plug 160 having an internally threaded bore 162 threading around the threaded periphery 164 of an upward projecting prong portion 166 integrally formed on the top of the core rod holder plate 72. Radially disposed set screws, such as set screw 159, immobilize the ring 158 relative to the plug 160 which, in turn, may also be provided with radial set screws, not shown, for immobilizing relative to the threaded prong 166. The upper end face 168 of the plug 160 acts as an adjustable abutment limiting the downward stroke of the inner punch holder plate 106, while the adjustment of the threaded ring 158 relative to the plug 160 in turn determines the limit of the downward stroke of the intermediary punch holder plate 96, by way of the abutment means formed by the rods 149, as previously explained.

The actuating member 120 has an enlarged radially extending annular portion defining a piston member 170 for a reciprocable cylinder designated generally at 172. The reciprocable cylinder 172 comprises an upper end plate 174 having a reduced diameter bore 176 through which projects a smooth surface projecting portion 178 of the actuating member 120 disposed between the threaded end portion 126 thereof and the enlarged diameter piston portion 170 thereof. A groove 180, provided with a seal 182, is disposed about the periphery of the portion 178, to prevent leakage to the ambient of fluid introduced into a chamber 184 thus formed between the upper face of the piston member 170 and the inner surface of the cylinder end plate 174. A passageway 186 places the chamber 184, through a fitting 188, in communication with a source of hydraulic or pneumatic fluid, not shown. The lower end of the reciprocable cylinder 172 is closed by an end plate 190 fastened to the upper end plate 174 by means of appropriate fasteners such as bolts 192. An undercut annular groove on the lower face of the piston member 170 forms a fluid chamber 194 into which fluid may be introduced by way of a passageway 196. The piston member 170 has a peripheral groove 198 provided with an annular ring or seal 200 which prevents fluid transfer from one side of the piston member 170 to the other side. An annular groove 202 provided with a seal 204 is disposed on the inner bore 206 of the end plate 190 and prevents leakage of fluid from the chamber 194 to the ambient.

The reciprocable cylinder 172 is guided during its stroke relative to the actuating member 120 by way of a pair of diametrically opposed bearing-provided bores 208 through each of which is passed a support column 76. It can thus be seen that when pressurized fluid is introduced by way of passageway 186 into the chamber 184, the reciprocable cylinder 172 is displaced upwardly to the position shown at FIG. 7 relative to the actuating member 122, and when fluid is exhausted from the chamber 184 while at the same time fluid under pressure is introduced into the chamber 194, the reciprocable cylinder 172 is displaced downwardly, relative to the actuating member 120, until an annular abutment 209 formed on the inner face of the end plate 174 engages the upper face of the piston member 170.

Figure 8:
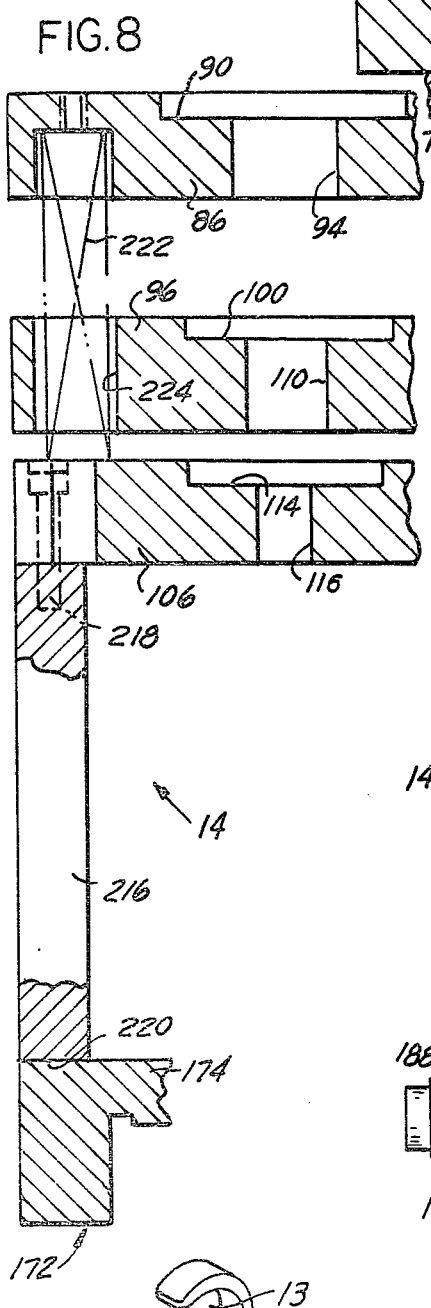
FIG. 8 is a partial sectional view thereof, taken along lines 8—8 of FIGS. 9 and 10.

Each of a pair of push-pull bars 210 has an end fastened to the top of the reciprocating cylinder 172 by means of a bolt 212. The other end of each push-pull bar 210 is fastened to the bottom of the outer punch holder plate 86 by way of a bolt 214. Each push-pull bar 210 passes freely through appropriate cut-out portions or notches 211 disposed at the edge of the inner punch holder plate 106 and of the intermediary punch holder plate 96. In this manner, the outer punch holder plate 86 and, consequently, the outer punch 16 are reciprocated by the reciprocable cylinder 172. The reciprocable cylinder 172 is in turn reciprocable both in unison with the actuating member 120 and relative to the reciprocating member 120, the latter when pressurized fluid is introduced in one of the chambers 184 or 194 while pressurized fluid is exhausted from the other chamber. The reciprocable cylinder 172 is also arranged to displace, as best shown at FIG. 8, the inner punch holder plate 106 by means of a push bar 216 disposed between the upper surface of the cylinder end plate 174 and the lower surface of the punch holder plate 106. The upper end of the push bar 216 is attached to the inner punch holder plate 106 by way of a bolt 218, while its lower end 220 only abuts against the upper face of the cylinder end plate 174 and may therefore separate therefrom under certain conditions of operation. As also shown at FIG. 8, a plurality of compressed coil springs 222 are disposed between the bottom of the outer punch holder plate 86 and the top of the inner punch holder plate 106, the coil springs 222 passing freely through appropriate bores 224 disposed through the intermediary punch holder plate 96, such that the outer punch holder plate 86 and the inner punch holder plate 106 are normally biased away from each other.

During operation of the tool capsule 14 mounted in the table of a powder compacting press, the ram 122 of the press is reciprocated by a cam, not shown, which in turn reciprocates the actuating member 120. The same cam, or another cam dependent from the press drive mechanism, operates in timed relationship with the operation of the ram 122 a two-way valve which permits to introduce pressurized fluid into the appropriate chamber 184 or 194, while exhausting fluid from the other chamber, such as to reciprocate the reciprocable cylinder 172 relative to the actuating member 120.

Figure 12:
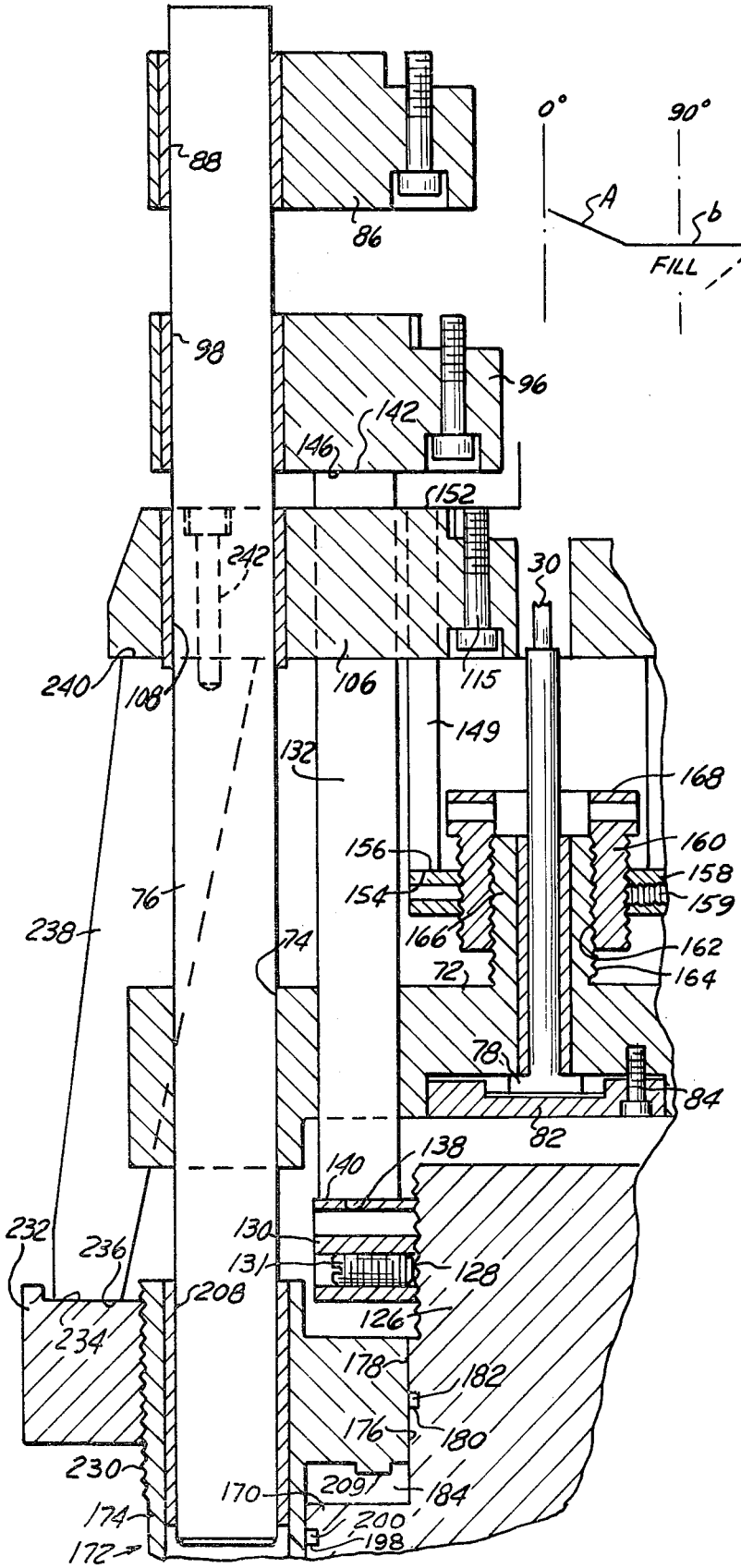
FIG. 12 is a partial view similar to FIG. 7, but showing a modification of the invention.
Figure 13:
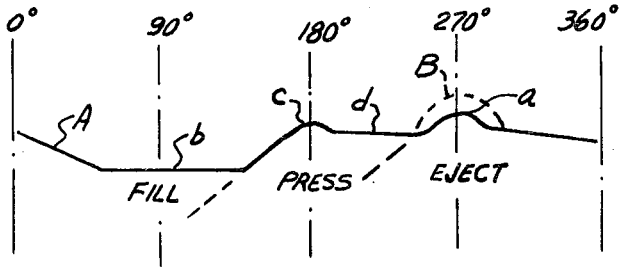
FIG. 13 is a diagram of the cam contour for actuating the punches of the punch and die assembly of the invention.

FIG. 7 illustrates the relative position of the elements causing full ejection of the compacted part, not shown at FIG. 7, from the die cavity. Such step is illustrated schematically at FIG. 6, and corresponds to the maximum extension outside of the die bore 18 of the outer punch 16, the intermediary punch 24 and the inner punch 28. FIG. 13 represents schematically a planar projection of an example of a press operating cam profile for actuating the ram 122 of the press which in turn actuates the actuating member 120. Full line curve A represents the profile of the cam, as a function of the rotation of the cam during a complete revolution. Ejection of the compacted part occurs at about 270° of rotation of the cam which corresponds to the top of the upward stroke of the actuating member 120 directly displacing through the threaded ring 130 and the bars 132 the intermediary punch holder plate 96 to the position illustrated at FIG. 7, which in turn displaces the intermediary punch 24 and its annular end face 40 to the top of its stroke to the position shown at FIG. 7 and also at FIGS. 5 and 6. Simultaneously therewith, pressurized fluid is introduced into the chamber 184 while fluid is exhausted from the chamber 194, such that the reciprocable cylinder 172, FIG. 7, is displaced upwardly relative to the piston member 170 of the actuating member 120. Through the push-pull bars 210, the outer punch holder plate 86 is therefore displaced upwardly in unison with the inner punch holder plate 106 being displaced upwardly by the push bars 216 engaging the top of the reciprocable cylinder 172. Consequently, the annular end face 38 of the outer punch 16 and the annular end face 42 of the inner punch 28 are displaced to the top of their stroke to the position illustrated at FIG. 7 and also at FIG. 6, flush with the annular end face 40 of the intermediary punch 24. The part 10 is therefore freed from the end of the intermediary punch 24 and can be removed from above the punches. The portion a of the cam contour A of FIG. 13 causes the upward stroke of the actuating member 120 and consequently of the intermediary punch 24, while the dashed line B at FIG. 12 represents the simultaneous travel of the outer punch 16 and the inner punch 28 due to the operation of the reciprocating fluid actuated cylinder 172.

Subsequently thereto, during the rotation of the cam from 270° to 360°, FIG. 13, pressurized fluid is exhausted from the chamber 184 while pressurized fluid is introduced into the chamber 194, therefore pulling downwardly the outer punch holder plate 86 and retracting the outer punch 16, while simultaneously allowing the outer punch holder plate 106 to move downwardly, under the pressure of the springs 222, thus also retracting the inner punch 28. However, simultaneously therewith, the ram 122 of the press is allowed by the cam to move downwardly such that all three punches are displaced downwardly to the feed position illustrated at FIG. 3 and corresponding to the flat portion b of the cam contour of FIG. 13 corresponding to the 90° angular rotation position of the cam. It is to be noted that in such position, the feed position, the annular faces 38 and 42 of respectively the outer punch 16 and the inner punch 28 are coplanar and at a given distance from the level of the annular end face 40 of the intermediary punch 24. In the feed position illustrated schematically at FIG. 3, the bottom surface 146 of the intermediary punch holder plate 96 engages the end face 152 of each stationary rod 148, and is prevented from moving downwardly any further than allowed by the adjustment of the threaded ring 158 around the threaded plug 160. However, the actuating member 120 is free to be displaced downwardly any amount permitted by the contour of the cam, as the bars 132 are free to separate at either end 138 or 142 from the top surface 140 of the collar 130 and from the bottom surface 146 of the intermediary punch holder plate 96.

Figure 3:
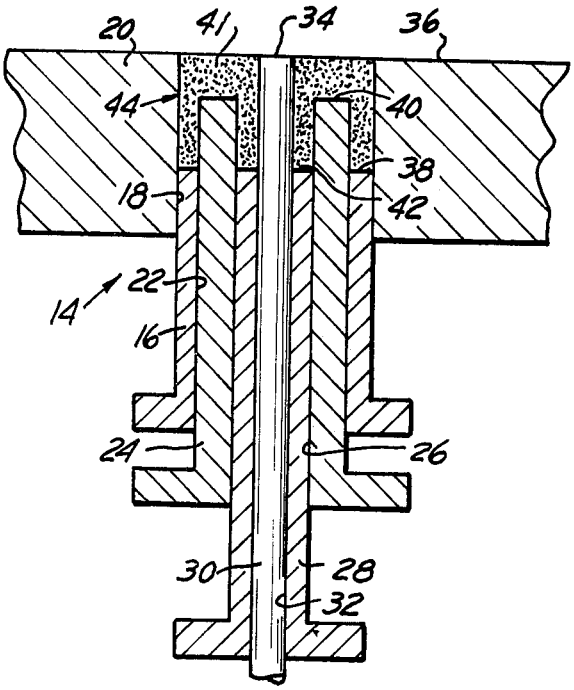
FIG. 3 is a schematic sectional view of a telescopic punch and die assembly according to the present invention, shown in the die cavity fill position.

After the die cavity 44 has been filled with powder material 41, as shown at FIG. 3, the anvil 46 is placed over the die cavity opening and the cam having rotated as shown at FIG. 13 to the press position c, corresponding to 180° of rotation of the cam, the actuating member 120 has been displaced upwardly, therefore displacing in turn the cylinder 172 until eventually the upper surface 140 of the ring 130 abuts against the end face 138 of the bars 132, causing the upper end face 132 of the bars to engage the lower surface 146 of the intermediary punch holder plate 96. Consequently, the intermediary punch 24 is displaced upwardly, but of a distance less than the outer punch 16 and the inner punch 28, with the result that in the press position of FIG. 4, the distance separating the plane of the annular end face 38 of the outer punch 16, coplanar with the annular end face 42 of the inner punch 28, from the plane of the annular end face 40 of the intermediary punch 24 is smaller than the distance corresponding to the feed position of FIG 3. Such a differential action is necessary to provide uniform density of the finished part, in view of its geometry.

After the part has been compacted, the contour of the cam is such as to slightly relieve the pressure on the ram and consequently on the actuating member 120, as shown by the relatively lower flat portion d of the cam contour A of FIG. 13. The anvil is removed from above the die cavity and the part is ejected to the position shown at FIG. 5 as a result of the ram and consquently the actuating member 120 being displaced upwardly by the contour a of the cam corresponding to 270° of rotation of the cam. At this time, as previously explained, fluid is removed from the chamber 194 while fluid is introduced into the chamber 184 thus displacing further upwardly the reciprocating cylinder 172 for displacing the part 10 to the full eject position of FIG. 6.

The assembly or tool set illustrated at FIG. 12 is in principle and structure alike the structure of FIGS. 7–11 with, however, an additional adjustment limiting the travel of the inner punch holder plate 106 towards the reciprocable cylinder 172. This adjustment is provided by a peripheral thread 230 formed on the outside surface of the cylinder housing 174 around which is threaded an adjusting ring 232 having an upper annular abutment surface 234 engaged with the end 236 of a pair of abutment bars 238 having their upper end 240 bolted to the bottom surface of the inner punch holder plate 106 by appropriate fasteners such as bolts 242. The bars 238 accomplish the same function as the bars 216 of FIG. 8, that is that of limiting the downward stroke of the inner punch holder plate 106 relative to the cylinder 172, but the structure of the adjusting ring 232 provides an adjustment of the limit of the downward motion of the inner punch plate holder 106, and consequently of the inner punch.

It can thus be seen that the present invention provides a multiple-action punch and die assembly with appropriate adjustment of the extreme positions of the punches during reciprocation, a further adjustment of the punch actuating member being provided in the press ram mechanism itself, and by combining the mechanical actuation of the punches by means of the press ram with auxilliary actuation by fluid means, a great flexibility of adjustment and stroke motion of the individual punches are obtained with a single-action cam driven press, in the course of a single revolution of the actuating cam.

Having thus described the invention by way of practical structural embodiments thereof, modifications whereof will be apparent to those skilled in the art, what is claimed as new is as follows:

1. In a powder compacting apparatus having a table and a single reciprocable ram disposed below said table, a punch and die unitary assembly for compacting powder material to a shaped article comprising a reciprocable punch actuating member, means rigidly coupling said punch actuating member to said ram, a stationary die plate mounted in an aperture in said table and having a die cavity, at least three coaxially arranged independently reciprocable punches associated with said die plate and comprising an outer punch, an intermediary punch disposed within said outer punch, and an inner punch disposed with said intermediary punch, means coupling said punch actuating member to said intermediary punch for upwardly displacing said intermediary punch, a piston-defining annular member peripherally disposed about a portion of said punch actuating member, a fluid actuated cylinder housing disposed peripherally about the annular member of said punch actuating member, said annular member separating said enclosure into opposed chambers for displacing said cylinder housing relative to said punch actuating member upon introduction of fluid into one or the other of said chambers, coupling means between said cylinder housing and said inner punch for upwardly displacing said inner punch, coupling means between said cylinder housing and said outer punch for upwardly and downwardly displacing said outer punch, means for introducing fluid into said cylinder and for exhausting fluid from said cylinder for reciprocating said outer punch and displacing said inner punch relative to said intermediary punch, first adjustable abutment means limiting downwardly the motion of said inner punch, second adjustable abutment means limiting downwardly the motion of said intermediary punch, and third adjustable abutment means for said coupling means between said punch actuating member and said intermediary punch.

2. The punch and die assembly of claim 1 further comprising fourth adjustable abutment means for said coupling means between said cylinder housing and said inner punch.

3. The punch and die assembly of claim 2 wherein said fourth adjustable abutment means comprises a thread peripherally formed about said cylinder housing, a ring having an internal thread engaging said peripheral thread and a bar member disposed between an end face of said ring and holding reciprocable means for said inner punch.

4. The punch and die assembly of claim 1 wherein said first adjustable abutment means comprises a stationary member having a peripheral thread, an internally threaded ring engaging said peripheral thread and an end face of said ring forming an abutment face engageable by reciprocable holding means for said inner punch.

5. The punch and die assembly of claim 4, further comprising a core rod disposed within said inner punch, said core rod being supported by said stationary member.

6. The punch and die assembly of claim 5 wherein said stationary member is longitudinally adjustable.

7. The punch and die assembly of claim 1 wherein said second adjustable abutment means comprises a stationary member having a peripheral thread, a first internally threaded ring engaging said peripheral thread, an end face of said first ring forming an abutment defining said first abutment means, a peripheral thread disposed about said first ring, a second internally threaded ring engaging the peripheral thread of said first ring, and an abutment bar disposed between an end face of said second ring and reciprocable holding means for said intermediary punch.

8. The punch and die assembly of claim 7 further comprising a core rod disposed within said inner punch, said core rod being supported by said stationary member.

9. The punch and die assembly of claim 8 wherein said stationary member is longitudinally adjustable.

10. The punch and die assembly of claim 1 wherein said third adjustable abutment means comprises a thread peripherally formed about a portion of said punch actuating member, a ring having an internal thread engaging said peripheral thread and a bar member disposed between an end face of said ring and holding reciprocable means for said intermediary punch.

11. The punch and die assembly of claim 1 wherein said punches are mounted on separate superimposed spaced apart holder plate members, and further comprising a support and guide column member slidably supporting said holder plate members substantially parallel and in alignment with each other.

12. The punch and die assembly of claim 11 further comprising biasing means disposed between the outer punch holding plate member and the intermediary punch holding plate member, said biasing means urging said plates away from each other.

13. The punch and die assembly of claim 11 further comprising biasing means between the holder plate members of said inner and outer punches.

14. The punch and die assembly of claim 11 further comprising biasing means between the holder plate members of said outer and intermediary punches and separate biasing means between the holder plate member of said outer and inner punches, said biasing means urging said holder plate members away from each other.

15. The punch and die assembly of claim 1 further comprising a core rod disposed within said inner punch.

16. The punch and die assembly of claim 11 wherein the relative longitudinal position of said core rod is fixedly adjustable.

* * * * *

UNITED STATES PATENT AND TRADEMARK OFFICE

CERTIFICATE OF CORRECTION

PATENT NO. : 4,153,399

DATED : May 8, 1979

INVENTOR(S) : Raymond P. DeSantis

It is certified that error appears in the above-identified patent and that said Letters Patent are hereby corrected as shown below:

Column 9, line 36, change "with" to --within--;

lines 43-44, change "enclosure" to --cylinder housing--.

Column 10, lines 50 and 51, change "holding" to --holder--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*